US006084389A

United States Patent [19]

Gens et al.

[11] Patent Number: 6,084,389

[45] **Date of Patent: *Jul. 4, 2000**

[54] VOLTAGE REGULATOR WITH INTERNAL GENERATION OF A LOGIC SIGNAL

[75] Inventors: Marc Gens, Saint Martin d'Uriage; François Van Zanten, Meylan, both of France

[73] Assignee: SGS-Thomson Microelectronics S.A., Gentilly, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/955,183

[22] Filed: Oct. 21, 1997

[30] Foreign Application Priority Data

Oct. 25, 1996 [FR] France ..... 96 13281

[51] Int. Cl.[7] ..... G05F 3/16

[52] U.S. Cl. ..... 323/315; 323/281

[58] Field of Search ..... 323/313, 314, 323/315, 316, 901, 282, 284, 288, 281, 280

[56] References Cited

U.S. PATENT DOCUMENTS

| | | | |
|---|---|---|---|
| 4,617,473 | 10/1986 | Bingham | 307/66 |
| 5,021,679 | 6/1991 | Fairbanks et al. | 307/66 |
| 5,153,535 | 10/1992 | Fairbanks et al. | 331/143 |
| 5,264,782 | 11/1993 | Newton | 323/288 |
| 5,280,233 | 1/1994 | Poletto et al. | 323/269 |
| 5,307,003 | 4/1994 | Fairbanks et al. | 323/222 |
| 5,367,247 | 11/1994 | Blocher et al. | 323/222 |
| 5,481,178 | 1/1996 | Wilcox et al. | 323/287 |

FOREIGN PATENT DOCUMENTS

| | | | |
|---|---|---|---|
| 0 687 051 | 12/1995 | European Pat. Off. | H02H 9/02 |

*Primary Examiner*—Adolf Denske Berhane
*Attorney, Agent, or Firm*—Wolf, Greenfield & Sacks, P.C.; James H. Morris; Theodore E. Galanthay

[57] ABSTRACT

The present invention relates to a voltage regulator including at least one input terminal for receiving a supply voltage; a circuit for generating a reference voltage proportional to a desired regulated output voltage; an amplifier of a signal of error between the reference voltage and the output voltage assigned with a coefficient of proportionality; a capacitor connected between an output terminal and the ground, further including means for supplying at least the circuit and the amplifier with the output voltage in case of a deficiency or a disappearing of the supply voltage present on the input terminal.

39 Claims, 7 Drawing Sheets

VOLTAGE REGULATOR WITH INTERNAL GENERATION OF A LOGIC SIGNAL

BACKGROUND OF THE INVENTION

1. Field of the Invention

The present invention relates to a voltage regulator for providing a regulated supply voltage to a load from an input voltage.

An example of application of the present invention concerns integrated circuits for remote-supply telephone sets where the supply is provided by the telephone line, either by the ring circuit when the set is not picked up, or by the speech circuit when the set is picked up, or even by a supply specific to the telephone set (for example, a battery).

2. Discussion of the Related Art

FIG. 1 shows a conventional diagram of a regulator for supplying a voltage regulated at a specific value from a single supply voltage.

Such a regulator receives, on an input terminal E, a supply voltage to be regulated V, and issues, on an output terminal S, a regulated voltage $V_R$. The regulator includes a circuit 1 supplying a reference voltage, and a circuit 2 for controlling a P-channel MOS power transistor M10, the source of which is connected to terminal E and the drain of which constitutes terminal S. Circuit 1 has the function of determining a precise reference voltage $V_{BG}$ for controlling, via control circuit 2, output voltage $V_R$. Circuit 1 includes two PNP-type bipolar transistors Q1 and Q2, the respective emitters of which are connected to terminal E and the respective collectors of which constitute two output terminals 3, 4, of circuit 1 for controlling circuit 2, as it will be seen hereafter. The bases of transistors Q1 and Q2 are connected to the collector of transistor Q1. The collectors of transistors Q1 and Q2 are respectively connected to the collectors of NPN-type bipolar transistors Q3 and Q4, the bases of which are interconnected and form a terminal 5 at reference potential $V_{BG}$. The emitter of transistor Q4 is connected to the ground via two resistors R1 and R2 mounted in series. The emitter of transistor Q3 is connected to the midpoint of the series association of resistors R1 and R2. Resistances R1 and R2 and the surface ratio of transistors Q3 and Q4 are chosen to obtain the desired voltage $V_{BG}$ with a given current in transistors Q1, Q2, Q3, and Q4. Circuit 1 includes a starting circuit formed of a current source I, the output of which is connected to the ground via a diode D and to the base of an NPN-type bipolar transistor $Q_D$, the collector of which is connected to terminal 4 and the emitter of which is connected to the midpoint of the series association of resistors R1 and R2.

Circuit 1 shown in FIG. 1 is generally referred to as a "band gap" circuit and its operation is perfectly well known.

Circuit 2 for controlling transistor M10 is formed of two PNP-type bipolar transistors Q5 and Q6, the respective emitters of which are connected to terminal E and the bases of which are respectively connected to terminals 4 and 3. The collectors of transistors Q5 and Q6 are connected to the respective drains of two N-channel MOS transistors M11 and M3 mounted as a current mirror, the sources of transistors M11 and M3 being connected to the ground and transistor M11 being diode-mounted. The collector of transistor Q6 constitutes an output terminal of circuit 2 connected to the gate of transistor M10. A resistive bridge formed by resistors R3 and R4 is generally connected between terminal S and the ground when the desired voltage $V_R$ is different from reference voltage $V_{BG}$. The midpoint of their dividing bridge is connected to terminal 5 of circuit 1 to constitute a reverse feedback loop enabling maintenance of reference voltage $V_{BG}$ on the bases of transistors Q3 and Q4. This reference voltage ensures that the currents in transistors Q3 and Q4 are equal. When there is a drift with respect to this reference voltage, the currents in transistors Q1 and Q2 are unbalanced. This current unbalance is amplified by circuit 2 and modifies potential $V_G$ to control transistor M10 to reestablish, via resistive bridge R3–R4, voltage $V_{BG}$ which makes the current in transistors Q3 and Q4 equal. Voltage $V_R$ is equal to $V_{BG}$(R3+R4)/R4.

A capacitor C is generally provided at the output of the regulator and is connected between terminal S and the ground. The function of this capacitor is, in particular, to ensure the stability of the reverse feedback loop.

A disadvantage of a regulator such as shown in FIG. 1 is that, if voltage V becomes lower than regulated voltage $V_R$, terminals E and S are short-circuited by transistor M10. Indeed, the substrate of MOS transistor M10 or its well generally is connected to its source, that is, to potential V. The substrate of a MOS transistor or its well is generally referred to as the "bulk" of the transistor to distinguish it from the general substrate of the integrated circuit whereon are implemented the different components. The bulk of a MOS transistor is generally symbolized by an arrow, the direction of which indicates the P or N type of the transistor channel. When voltage $V_R$ is higher than voltage V, the PN junction between the drain and the bulk of transistor M10 is forward biased and the transistor then is short-circuited by the drain/bulk diode. Further, the drain and the source of transistor M10 exchange (the current being reversed), which turns the reverse feedback operated by circuit 1 into a feedback.

This short-circuiting is prejudicial to a second function of capacitor C, which is to temporarily supply the load in case of a deficiency or a disappearing of supply voltage V. For example, when the regulator is used to supply a microprocessor, it is desired to maintain the supply of the microprocessor for the time required for it to store the data, after a deficiency or a disappearing of the supply voltage. Voltage $V_R$ is generally compared with a threshold by means of a circuit external to the regulator to detect a decrease in voltage $V_R$ and then use capacitor C to temporarily supply the microprocessor before the disappearing of voltage $V_R$.

A conventional solution to insulate terminal E from the rest of the regulator, when the supply voltage becomes lower than voltage $V_R$, is to place a diode at the input of the regulator. However, a disadvantage of such a solution is that it introduces a voltage drop of about 0.7 volt between the input and output terminals of the regulator.

Insulating diodes are also used when it is desired to supply the regulator such as shown in FIG. is 1 from different voltages by selecting, as the voltage to be regulated, that having the highest potential.

FIG. 2 shows a conventional example of a voltage regulator automatically selecting, among two supply voltages $V_M$ and $V_L$ arriving on two input terminals $E_M$ and $E_L$, the highest voltage. Circuits 1 and 2 shown in FIG. 1 have been functionally schematized in FIG. 2 by a reference voltage source 1 and by an amplifier 2 receiving, as an input, reference voltage $V_{BG}$ and the potential of the midpoint of resistive dividing bridge R3–R4. Amplifier 2 and generator 1 are biased by the highest supply voltage $V_M$ or $V_L$ by means of diodes, respectively D1, D2, and D3, D4 interposed in series between each terminal $E_M$ or $E_L$ and the biasing terminal of generator 1 or of amplifier 2.

If such a circuit does enable selection of the highest supply voltage, the use of diodes has, as previously, the disadvantage of introducing a voltage drop of about 0.7 volt in series with the regulator.

SUMMARY OF THE INVENTION

The present invention aims at providing a new voltage regulator for automatically generating a logic signal indicating, while the supply voltage is not sufficient to supply the desired regulated voltage, that the output voltage is lower than a given threshold.

The present invention also aims at improving or optimizing the use of a decoupling capacitor placed at the output of the regulator for temporarily supplying the charge when the unregulated supply voltage is lower than the regulated output voltage.

To achieve these and other objects, the present invention provides a voltage regulator including at least one input terminal for receiving a supply voltage, a circuit for generating a reference voltage proportional to a desired regulated output voltage, an amplifier of a signal that represents the error between the reference voltage and the output voltage assigned with a coefficient of proportionality, a capacitor connected between an output terminal and the ground, and means for supplying at least the circuit and the amplifier with the output voltage in case of a deficiency or a disappearing of the supply voltage present on the input terminal.

According to an embodiment of the present invention, the regulator further includes a comparator for issuing, when the regulator is supplied by the output voltage, a logic signal indicating that the output voltage becomes lower than a threshold value proportional to the reference voltage.

According to an embodiment of the present invention, the regulator includes a conducting means for connecting the output voltage to the reference voltage in case of a deficiency or a disappearing of the supply voltage present on the input terminal.

According to an embodiment of the present invention, the connection between the output voltage and the reference voltage is resistive.

According to an embodiment of the present invention, the regulator includes at least a first power transistor having a first power electrode directly connected to the input terminal and a second electrode connected to the output terminal, the conducting means being formed of a second transistor of low power in series with a first resistor mounted in parallel on at least a second resistor helping to set the proportionality coefficient.

According to an embodiment of the present invention, the regulator includes a circuit for turning on the transistor associated with the highest voltage among the supply voltage and the output voltage.

According to an embodiment of the present invention, at least the first power transistor is a P-channel MOS transistor, the bulk of which is biased by means of the highest voltage between the input voltage and the output voltage.

These objects, characteristics and advantages as well as others, of the present invention, will be discussed in detail in the following non-limiting description of specific embodiments of the present invention, in relation with the accompanying drawings.

DETAILED DESCRIPTION

For clarity, the same elements have been referred to by the same references in the different drawings.

Figure 3:
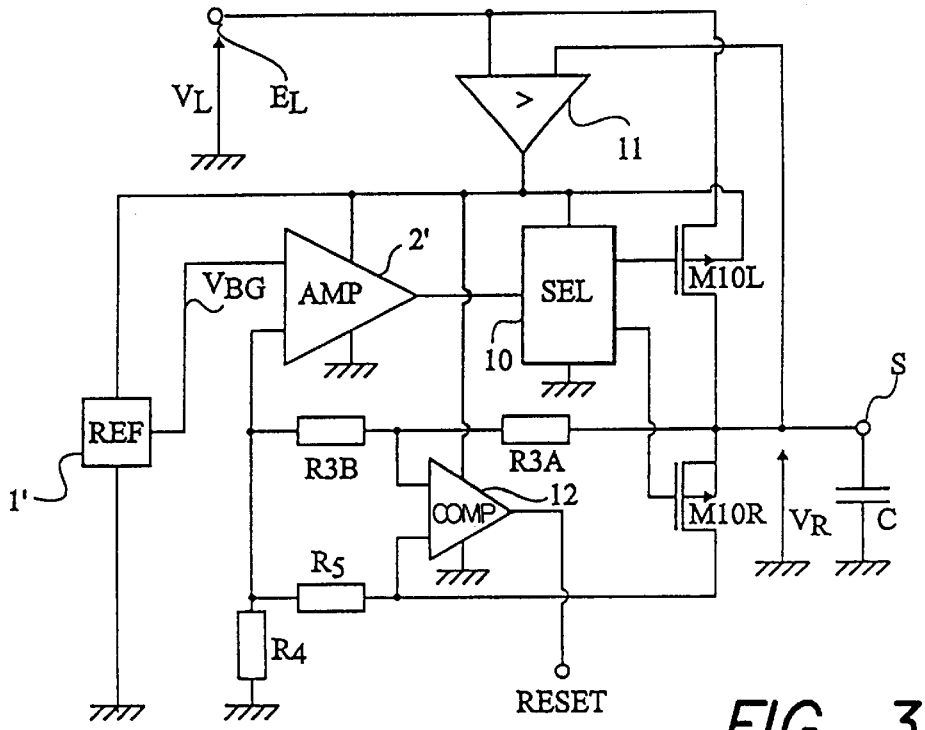
FIG. 3 shows a functional diagram of a first embodiment of a voltage regulator according to the present invention.

FIG. 3 shows a first embodiment of a voltage regulator according to the present invention. This regulator includes an input terminal $E_L$, for receiving a supply voltage $V_L$, and an output terminal S, associated with a decoupling capacitor C and providing a regulated voltage $V_R$. According to this embodiment, the regulator includes a P-channel MOS power transistor M10L having a first power electrode connected to terminal $E_L$ and a second power electrode connected to terminal S. A circuit 1' provides a reference voltage $V_{BG}$ and is associated with an amplifier 2'. A resistive dividing bridge, formed of resistors R3A, R3B, and R4, is mounted in series between terminal S and the ground. The midpoint of the association of resistors R3A and R3B with resistor R4 is connected to a first input of amplifier 2', a second input of which receives voltage $V_{BG}$.

The regulator further includes a comparator 12 associated with a P-channel low power transistor M10R for generating a logic signal RESET. This signal RESET is meant to indicate a lack of supply of the regulator by means of voltage $V_L$, that is, the highest voltage of the regulator is voltage $V_R$, and output voltage $V_R$ is lower than a determined threshold. This signal RESET is, for example, used to indicate to the load (not shown), for example a microprocessor, that the voltage that it receives is now supplied by capacitor C only and is thus only temporary. Transistor M10R is connected, via its source, to terminal S and, by its drain, to a first input terminal of comparator 12 as well as, via a resistor R5, to the midpoint of the series association of resistors R3A and R3B with resistor R4. The gate of transistor M10R is connected to a selection circuit 10 associated with amplifier 2' for selecting the transistor to be turned on among transistors M10L and M10R according to that of voltages $V_L$ and $V_R$ which is the highest.

The switching point of comparator 12 is determined by the values of resistors R3A, R3B, R4, and R5. Its value corresponds to: $V_{BG}.[(R5/R4).(R3A+R3B)/(R5+R3B)+1]$.

An advantage of the present invention is that transistor M10R enables maintenance of the reverse feedback loop even when voltage $V_R$ is the highest voltage, thus enabling the regulator to integrate the generation of a RESET signal when voltage $V_R$ corresponds to the discharge of capacitor C and becomes lower than a threshold voltage. This enables to very precisely determine this threshold voltage since it is linked with the voltage $V_{BG}$ set by circuit 1'. Further, this minimizes the consumption linked to the generation of the RESET signal since the components of the regulator, which are generally chosen for their low consumption, are used.

A characteristic of the present invention is that circuits 1', 2', and 10 are supplied with the highest voltage among voltages $V_L$ and $V_R$ by means of a comparator 11, two inputs of which are respectively connected to terminals $E_L$ and S.

Another characteristic of the present invention is that the bulk (substrate or well) of MOS transistor M10L is connected to the highest potential among voltages $V_L$ and $V_R$. This connection has been symbolized in FIG. 3 by a connection between the bulk of transistor M10L and the output of comparator 11. Thus, even if voltage $V_R$ is higher than voltage $V_L$, transistor M10L is not short-circuited since its bulk also is at voltage $V_R$, which forbids any forward biasing of the drain/bulk and drain/source junctions.

Figure 4:
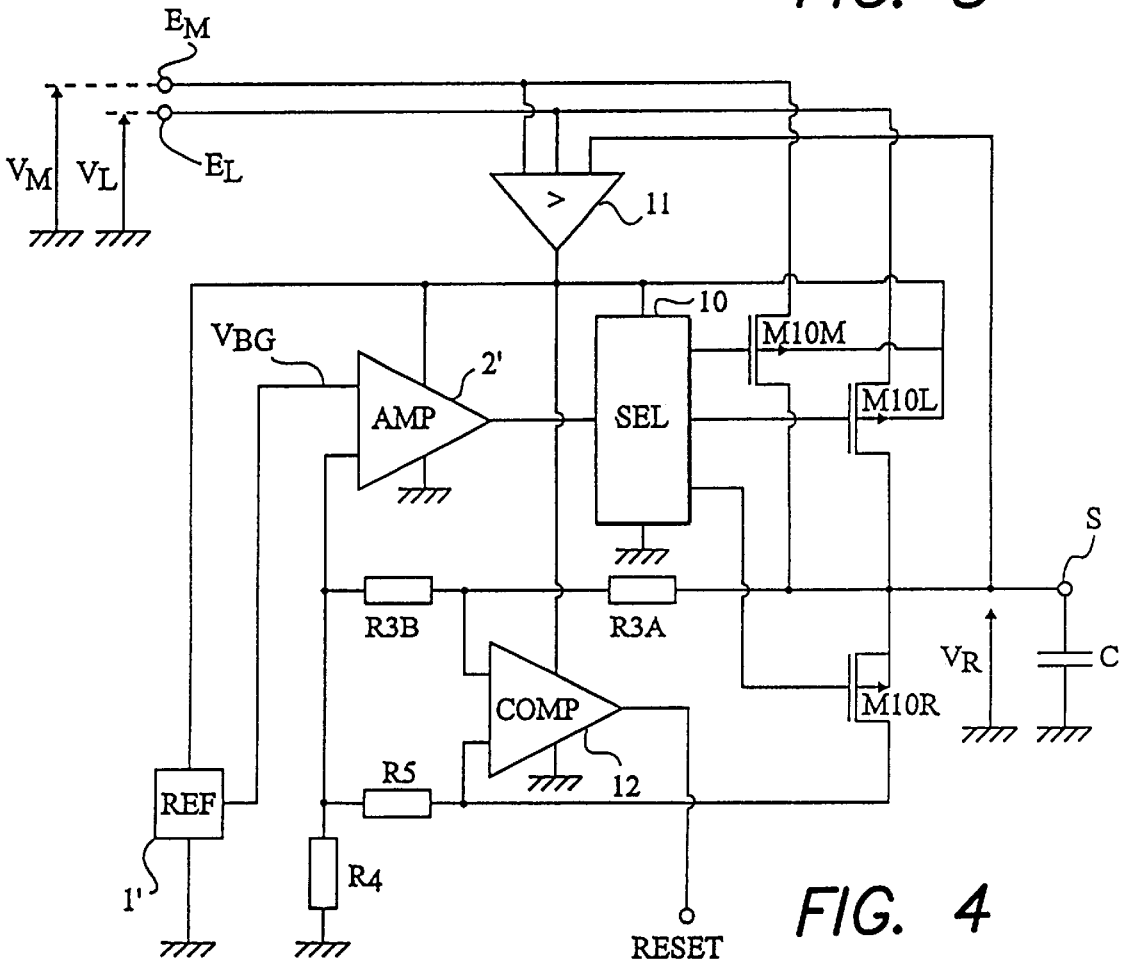
FIG. 4 shows a functional diagram of a second embodiment of a voltage regulator according to the present invention.

FIG. 4 shows a second embodiment of the present invention, wherein the regulator further includes a second P-channel MOS transistor M10M having a first power electrode connected to a second supply terminal $E_M$ and a second power electrode connected to terminal S. Terminals $E_M$ and $E_L$ are meant to receive independent supply voltages and circuit 11 includes three inputs respectively receiving voltages $V_M$, $V_L$, and $V_R$. Circuit 10 selects the transistor to be turned on among transistors M10M, M10L, and M10R and the bulk of transistor M10M is connected to the output of comparator 11.

If one of voltages $V_M$ or $V_L$ is sufficient (higher than voltage $V_R$), the transistor M10L or M10M associated with the lowest supply voltage $V_L$ or $V_M$ is blocked by circuit 10 and, even if this lowest voltage $V_L$ or $V_M$ is lower than voltage $V_R$, this transistor is not short-circuited since its bulk is brought to the highest potential. These characteristics will be better understood in relation with FIGS. 7 and 8.

An advantage of this embodiment is that the lowest voltage $V_M$ or $V_L$ is insulated from the regulator.

Another advantage of the present invention is that the voltage drop between the input and output terminals of the regulator is low. Indeed, it is limited to about 0.1 volt corresponding to the voltage drop in MOS power transistors in the on-state.

In practice, means for selecting the highest voltage (generally shown by comparator 11 in FIGS. 3 and 4) are provided distinctly for circuit 1', circuits 2' and 10, and for the biasing of the bulks of transistors M10M and M10L. Thus, a bulk biasing circuit for transistors M10M and M10L and for other P-channel MOS transistors of the regulator is provided.

The present invention will be described hereafter in relation with the second embodiment (FIG. 4). The modifications to be made to obtain the regulator discussed in relation with FIG. 3 may be induced from the respective functions of the different components described hereafter.

Figure 5:
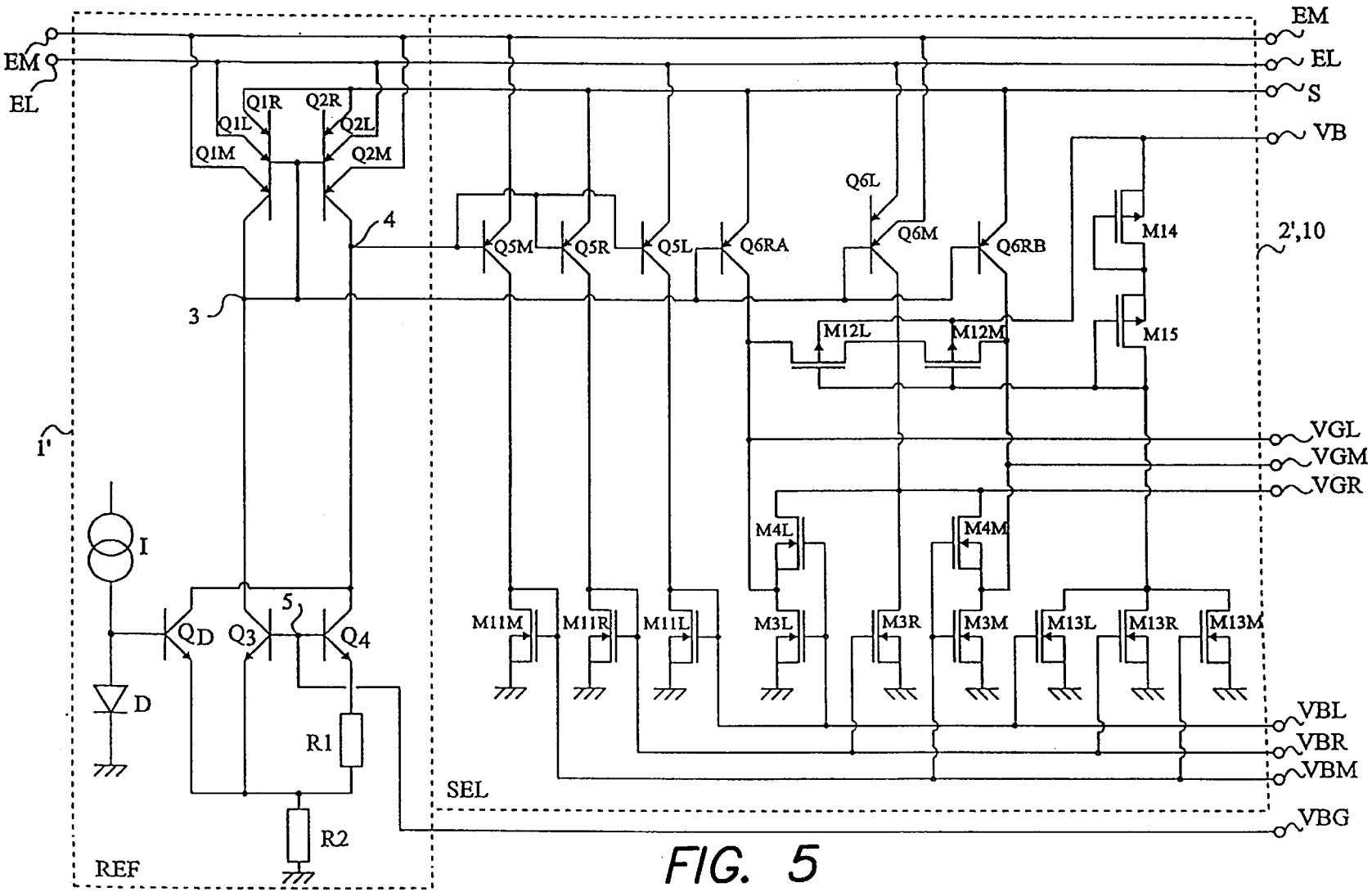
FIGS. 5 and 6 show a detailed diagram of an embodiment of a regulator such as shown in FIG. 4.
Figure 6:
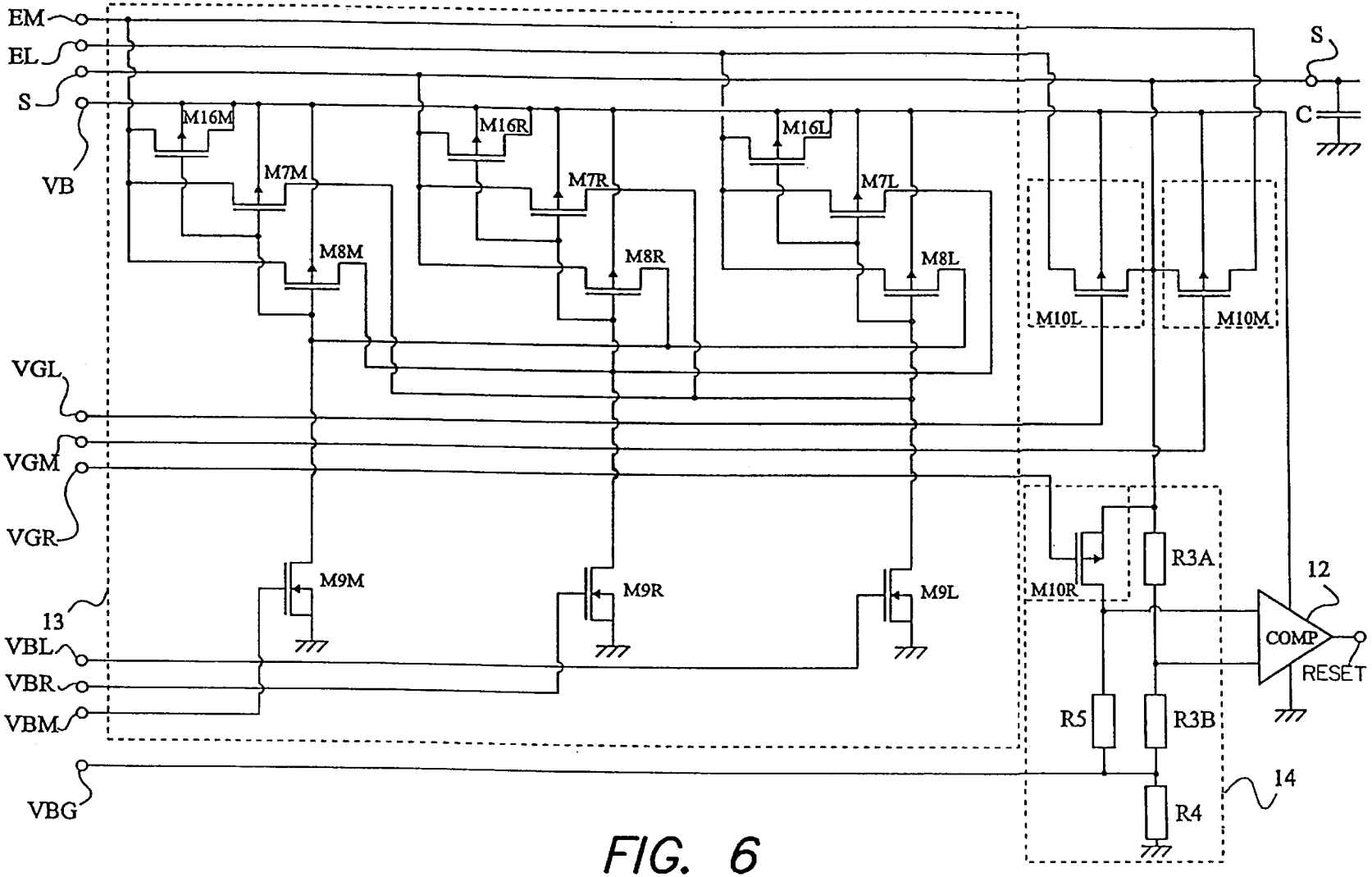

FIGS. 5 and 6 show a detailed diagram of a voltage regulator according to the present invention. FIG. 5 shows an embodiment of circuit 1' for generating the reference voltage $V_{BG}$, as well as of the associated control circuit 2' and selection circuit 10. FIG. 6 shows an embodiment of a circuit 13 for biasing the bulks of the P-channel MOS transistors, as well as transistors M10L, M10M, and M10R and the resistive means 14 associated with comparator 12 and the reverse feedback of the regulator.

Figure 1:
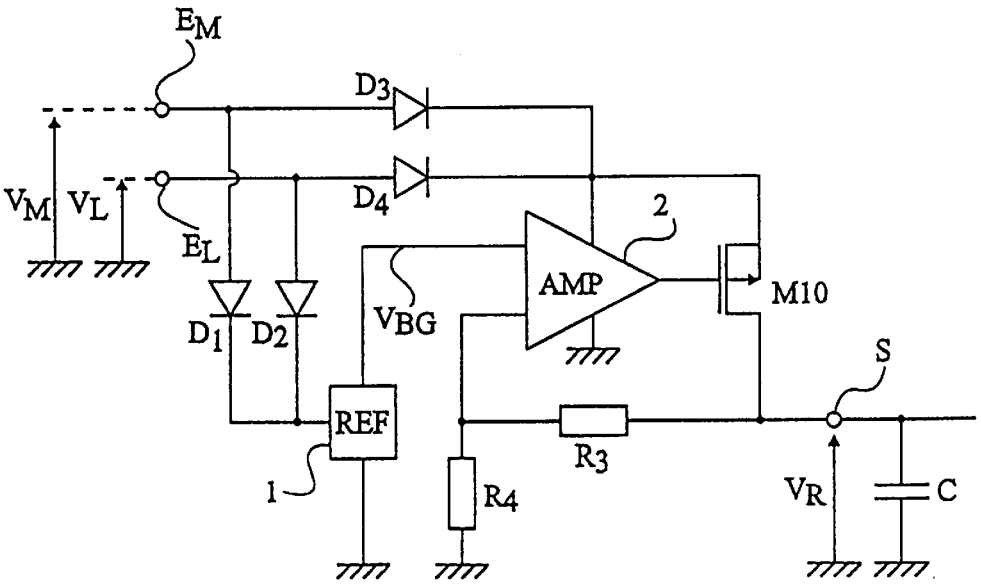
FIG. 1 (PRIOR ART)
FIGS. 1 and 2, which have been previously described, are meant to show the state of the art and the problem to solve.
Figure 2:
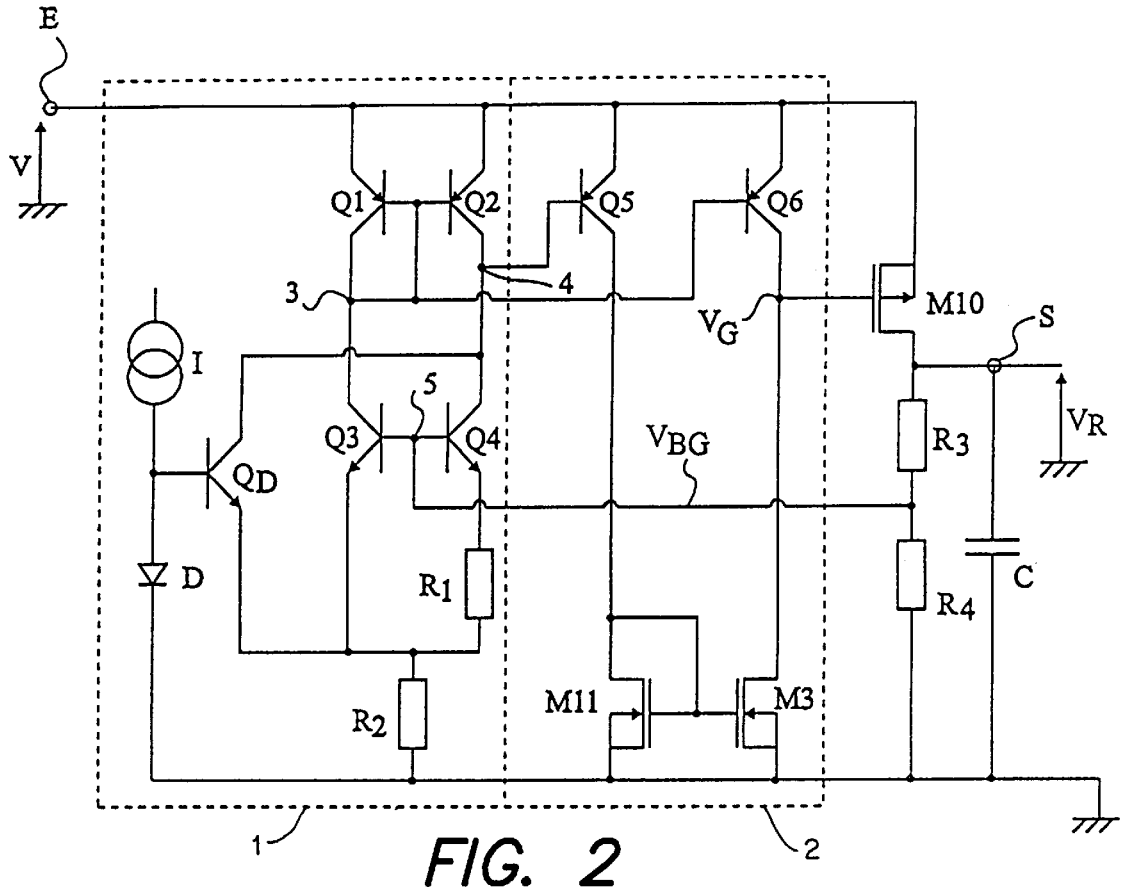
FIG. 2 (PRIOR ART)

Circuit 1' is formed of a current source I, a diode D, resistors R1 and R2, and transistors $Q_D$, Q3, and Q4 such as described previously in relation with FIG. 1. Transistors Q1 and Q2 of FIG. 1 are, for example, each replaced with three PNP-type bipolar transistors respectively associated with terminals $E_M$, $E_L$, and S or, as shown, by two multi-emitter transistors, the respective collectors of which are connected to the collectors of transistors Q3 and Q4 and respectively define output terminals 3 and 4 of circuit 1'. A first emitter, respectively Q1M or Q2M, of the multi-emitter transistors is connected to terminal $E_M$, a second emitter, respectively Q1L or Q2L, is connected to terminal $E_L$, and a third emitter, respectively Q1R or Q2R, is connected to terminal S. The operation of circuit 1' is similar to that of circuit 1 described in relation with FIG. 1, with the difference that its supply voltage always is the highest voltage among voltages $V_M$, $V_L$, and $V_R$.

Terminal 4 is connected to the respective bases of three PNP-type bipolar transistors Q5M, Q5R, and Q5L of circuit 2', the emitters of which are respectively connected to terminals $E_M$, S, and $E_L$. The respective collectors of transistors Q5M, Q5R, and Q5L are connected to the drains of N-channel MOS transistors M11M, M11R, and M11L, the respective sources of which are grounded. N-channel MOS transistors M3L, M3R, and M3M, the respective sources of which are grounded, are diode-mounted on transistors M11L, M11R, and M11M. The respective drains of transistors M3L and M3M are connected, via an N-channel MOS transistor M4L, M4M, the gate of which is connected to the respective transistor M3L or M3M, to the collector of a PNP-type bipolar transistor Q6L, Q6M (or to the common collector of a multi-emitter transistor). The drain of transistor M3R is directly connected to the collectors of transistors Q6L and Q6M. The respective drains of transistors M3L and M3M are also connected to the collector of a PNP-type bipolar transistor, respectively Q6RA or Q6RB, the emitter of which is connected to terminal S. The respective bases of transistors Q6RA, Q6RB, Q6L, and Q6M are connected to terminal 3. The collectors of transistors Q6RA and Q6RB issue, respectively, control potentials $V_{GL}$ and $V_{GM}$ on the gates of transistors M10L and M10M (FIG. 6). The collector of multi-emitter transistor Q6L-Q6M issues a control potential $V_{GR}$ on the gate of transistor M1OR (FIG. 6).

The operation of circuit 2' described hereabove may be induced from that of circuit 2 of FIG. 1 as concerns transistors Q5, Q6, M3, and M11 assigned with the respective letters M, R, and L, the highest of voltages $V_M$, $V_L$, $V_R$ turning on the transistors Q5, Q6, M3, and M11 assigned with the corresponding letter and turning off the other transistors.

According to the present invention, circuit 10 includes two P-channel MOS transistors M12L and M12M connected in series between the respective collectors of transistors Q6RA and Q6RB. The common electrode of transistors M12L and M12M is connected to the common collector of transistors Q6L and Q6M. The function of transistors M12L and M12M is to block the two power transistors among transistors M10L, M10M, and M10R which are associated with the two lower voltages among voltages $V_M$, $V_L$, and $V_R$. Two P-channel MOS transistors M14 and M15 are connected in series and diode-connected between a terminal $V_B$ and the common gates of transistors M12L and M12M. Terminal $V_B$ is the output terminal of circuit 13 for biasing the bulks of the P-channel transistors which will be described hereafter in relation with FIG. 6. Terminal $V_B$ is at the potential of the highest voltage among voltages $V_M$, $V_L$, and $V_R$. The drain of transistor M15 is connected to the common drain of three N-channel MOS transistors M13L, M13R, and M13M which are mounted as current mirrors on the respective transistors M11L, M11R, and M11M. The function of transistors M14, M15, M13R, M13L, and M13M is to bias the gates of transistors M12L and M12M at a high potential so that their source potential is itself high enough to guarantee the blocking of two out of the three transistors M10L, M10M, and M10R. The operation of circuits 2' and 10 will be better understood in relation with FIGS. 7 and 8.

Circuit 13 (FIG. 6) for biasing the bulks of the P-channel transistors, especially of transistors M10L and M10M, at the highest voltage among voltages $V_M$, $V_L$, and $V_R$ includes three similar assemblies, each formed of three P-channel MOS transistors and of an N-channel MOS transistor. Each group of four transistors includes a P-channel transistor, respectively M16M, M16R, or M16L, connected between terminal $E_M$, S, or $E_L$ and terminal $V_B$. The respective gates of transistors M16M, M16R, and M16L are connected to the source of the N-channel MOS transistor M9M, M9R, and M9L of the corresponding group. Transistors M9M, M9R, and M9L are mounted as current mirrors on the respective transistors M11M, M11R, and M11L (FIG. 5). In FIGS. 5 and 6, the respective gates of transistors M11M, M11R, and M11L have been designated by terminals $V_{BM}$, $V_B$R, and $V_B$L to enable the continuation of the connections between FIGS. 5 and 6. The two other P-channel MOS transistors, respectively M7M and M8M, M7R and M8R, M7L and M8L, of each group of circuit 13 have a first electrode connected to the terminal, respectively $E_M$, S, or $E_L$, their gates being connected to the drain of the transistor M9 of the corresponding group. A second electrode of transistors of transistor M7M and M7R is connected to the drain of transistor M9L. A second electrode of transistors M8L and M8R is connected to the drain of transistor M9M. A second electrode of transistors M7L and M8M is connected to the drain of transistor M9R. Only the group of transistors associated with the highest voltage among voltages $V_M$, $V_L$, and $V_R$ conducts, the gates of the P-channel transistors of the corresponding group being grounded by the N-channel transistor M9M, M9R, or M9L which conducts, due to the mirror assembly on transistors M11M, M11R, and M11L. The transistor M16 of the corresponding group establishes the potential of terminal $V_B$ at the highest voltage and the transistors M7 and M8 of this group render the six P-channel MOS transistors of the two other groups non-conducting by bringing their respective gates to the highest potential. All the bulks of the P-channel transistors of circuit 13 are connected to terminal $V_B$ to avoid any short-circuiting by the drain/bulk or source/bulk diodes.

In the embodiment shown in FIG. 6, comparator 12 for generating the RESET signal is biased by being connected to terminal $V_B$. This comparator 12 having a very low consumption, the potential of terminal $V_B$ is substantially unmodified. However, as an alternative, the biasing of comparator 12 may be associated with a transistor assembly selecting, among voltages $V_M$, $V_L$, and $V_R$, the highest voltage. Comparator 12 can also be supplied by voltage $V_R$ only. Indeed, upon generation of logic signal RESET, the highest voltage will always be voltage $V_R$.

Figure 7:
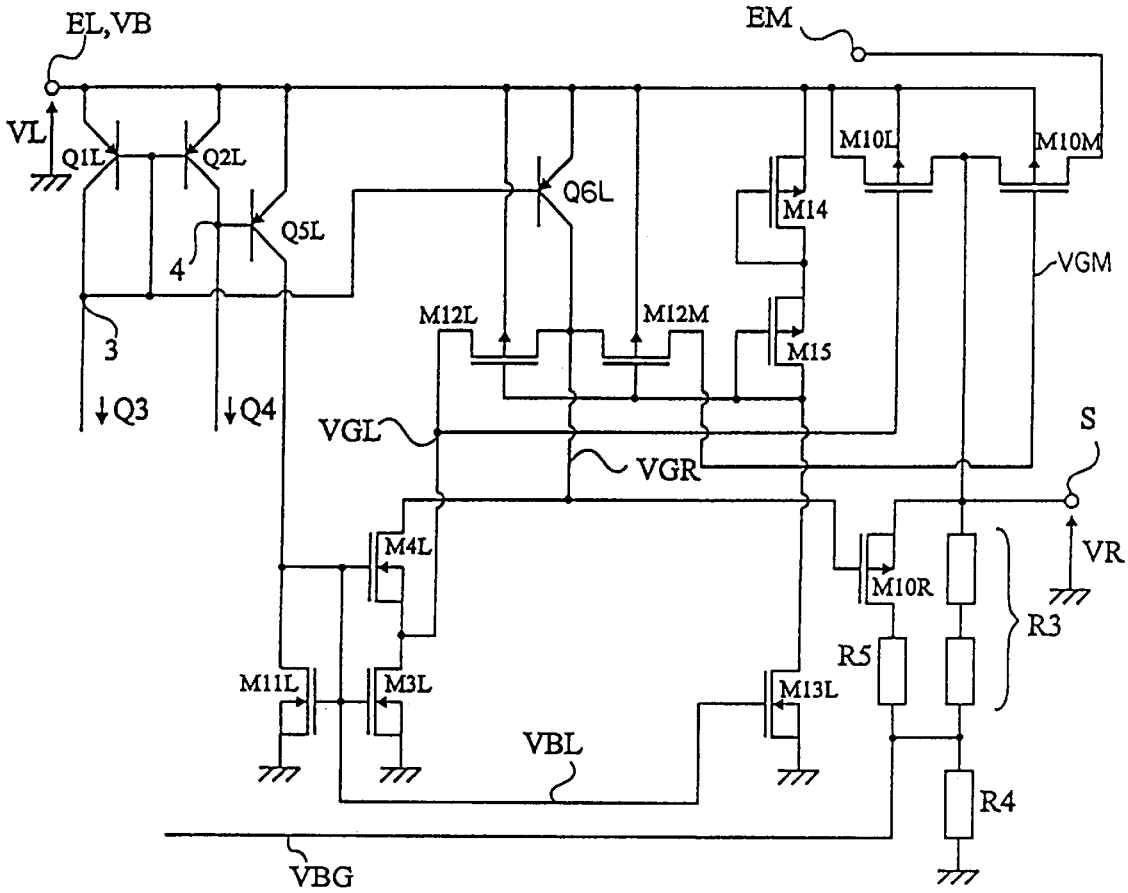
FIG. 7 is a partial simplified diagram of the regulator shown in FIGS. 5 and 6 illustrating its operation when an unregulated supply voltage is higher than the desired regulated output voltage.

FIG. 7 illustrates the operation of the voltage regulator according to the present invention when the highest voltage of the assembly corresponds to one of supply voltages $V_M$ and $V_L$. The operation is similar whichever voltage $V_M$ or $V_L$ is the highest.

The case shown in FIG. 7 corresponds to a normal operation of the regulator where the regulated voltage $V_R$ is generated from voltage $V_L$. For clarity, the non-conducting transistors which do not intervene in the operation are not shown in FIGS. 5 and 6, and terminals $V_B$ and $E_L$ have been confounded. Circuit 1' has only been partially shown. Transistor Q6L now is in series with transistor M12L, the gate of which is biased by transistors M14 and M15, and with transistor M3L. Transistor Q6L associated with transistor M12L thus constitutes a cascode current source charged by transistor M3L, which is controlled by transistors Q2L, Q5L, and M11L, and the output VGL of which is connected to the gate of transistor M10L. The operation described in relation with FIG. 1 is thus reproduced. The potential of the gates of transistors M12L and M12M is substantially equal to $V_L-2V_T$H, where $V_T$H represents the threshold voltage of transistors M14 and M15. Potential $V_{GR}$ present on the source of transistor M12L thus is substantially equal to $V_L-2V_T$H, plus the gate-source voltage drop of transistor M12L. This voltage drop is equal to threshold voltage $V_{TH}$ of transistor M12L, plus a term due to the drain-source current of transistor M12L and corresponding to the parabolic component of its gate-source voltage. Thus, potential $V_{GR}$ is higher than $V_L-V_T$H. Potential $V_G$M is, by the same line of argument, equal to potential $V_{GR}$, transistor M12M being conductive but being run through by no current.

Since $V_{GR}=V_G M>V_L-V_T$H, transistors M10R and M10M are non-conducting, since their respective sources are at potentials lower than voltage $V_L$. Turning off transistor M10M enables insulation of supply $V_M$, while turning off transistor M10R results in the fact that the resistance of the reverse feedback loop corresponds to resistance R3 (R3A+R3B). The output voltage $V_R$ is equal to $V_B$G.(R3+R4)/R4. It should be noted that, since the bulk of transistor M10M is connected to potential $V_L$, terminal $E_M$ is effectively completely insulated from the regulator and there is no short-circuit between terminals $E_M$ and S.

In the case where the difference between voltage $V_L$ and voltage $V_R$ is not high enough, the potential difference between the source and the drain of transistor M10L is too low to provide enough current to the load connected to terminal S. The reverse feedback loop formed of resistors R3A and R3B, of transistor Q3 (not shown in FIG. 6), of transistor Q6L, and of transistor M12L, then lowers potential $V_{GL}$ down to a value close to the ground. Transistor M3L then operates as a triode, which renders transistor M4L conducting. Transistor M4L, when conducting, turns on transistor M10R which then short-circuits resistors R3A and R3B. Voltage $V_R$ cannot, in this case, be maintained at the desired nominal value and decreases. However, the reverse feedback loop continues to operate via transistor M10R and resistor R5, which guarantees the maintaining of voltage $V_{BG}$ at the chosen reference voltage.

When voltage $V_L$ becomes lower than voltage $V_R$ or disappears, the regulator then is in an operating mode where it is supplied by voltage $V_R$ and where it generates signal RESET which will be described hereafter in relation with FIG. 8.

Figure 8:
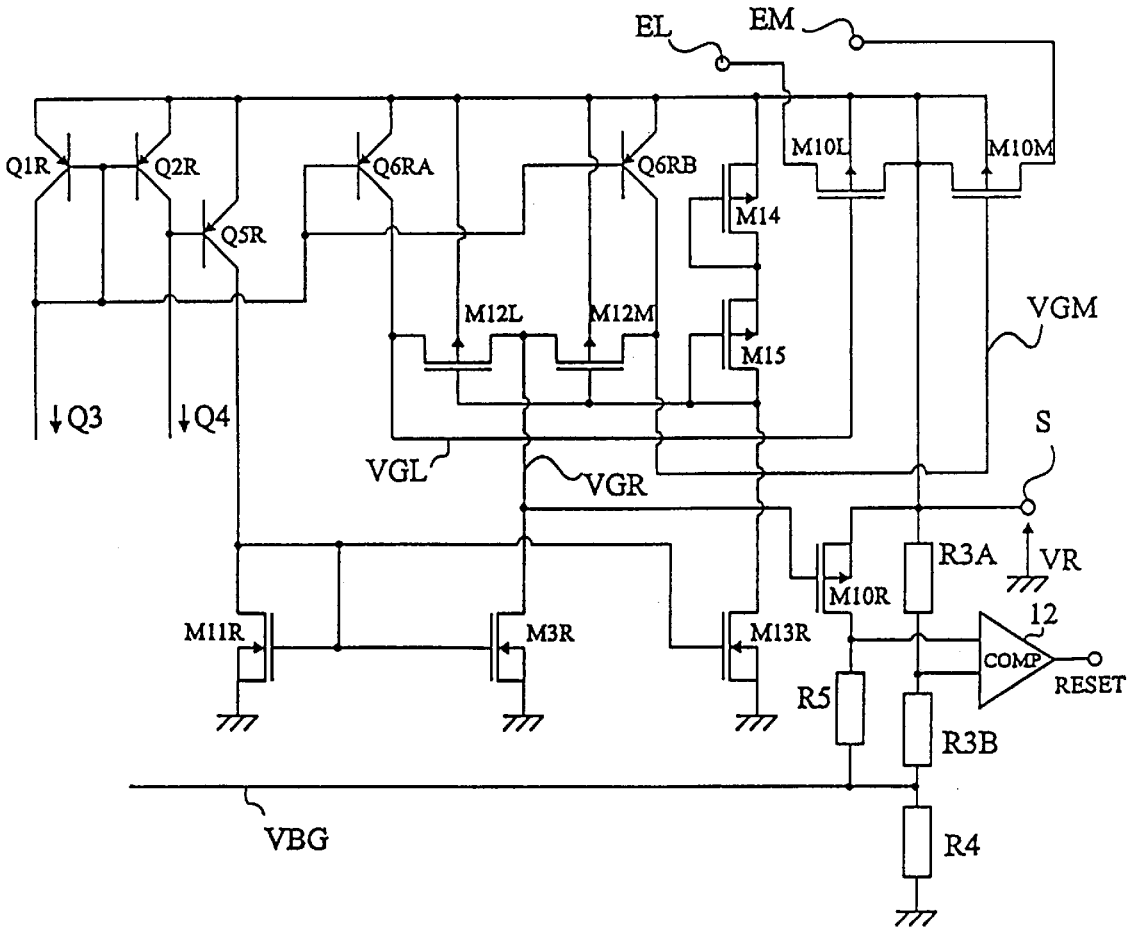
FIG. 8 is a partial simplified diagram of the regulator shown in FIGS. 5 and 6 illustrating the operation thereof when none of the supply voltages is higher than the desired regulated output voltage.

In a like manner as in FIG. 7, FIG. 8 does not show the transistors of FIGS. 5 and 6 which are non-conducting and which do not intervene in the operation. In the case shown in FIG. 8, it is assumed that voltage $V_R$ is higher than voltages $V_L$ and $V_M$.

The two transistors Q6RA and Q6RB have their base-emitter junctions in parallel and their currents are thus equal. Since a current flows in both transistors M12L and M12M, a cascode current source is obtained from a functional point of view, as previously. However, the upper portion (Q6RA, M12L and Q6RB, M12M) here is divided in two and provides, on the respective sources of transistors M12L and M12M, the two control voltages VGL and VGM which are both higher than $V_R-V_TH$. Transistors M10M and M10L are thus rendered non-conductive and, since their respective bulks are at potential $V_R$, terminals $E_M$ and $E_L$ are completely insulated from the regulator. The lower part (M12L, M12M, and M3R) of the cascode current source provides voltage $V_{GR}$, determined by the reverse feedback loop including transistor M10R and resistor R5. Thus, reference voltage $V_{BG}$ is effectively maintained at the specified value. According to the present invention, voltage $V_{BG}$ is then used to index the threshold from which signal RESET is generated by means of comparator 12. The switching of comparator 12 occurs when voltage $V_R$ becomes lower than $V_BG.[(R5/R4).(R3A+R3B)/(R5+R3B)+1]$.

According to the present invention, all the bulks of the N-channel MOS transistors are connected to their sources. Conversely, all the bulks of the P-channel MOS transistors of circuit 13, as well as the bulks of transistors M12L and M12M and of power transistors M10L and M10M, are connected to terminal $V_B$ at the potential of the highest voltage. The bulk of transistor M14 is also connected to voltage $V_B$ as its source, and the bulks of transistors M10R and M15 are connected to their respective sources.

The implementation and the operation of a regulator such as shown in FIG. 3 may be induced from the discussion of FIGS. 5 to 8. One only needs modify all the transistors associated with supply terminal $E_M$ (that is, all the transistors referred to by letter M) and transistor Q6RB (FIG. 5). It should however be noted that a regulator implemented in accordance with FIGS. 5 and 6 also operates with a single supply voltage.

Figure 9:
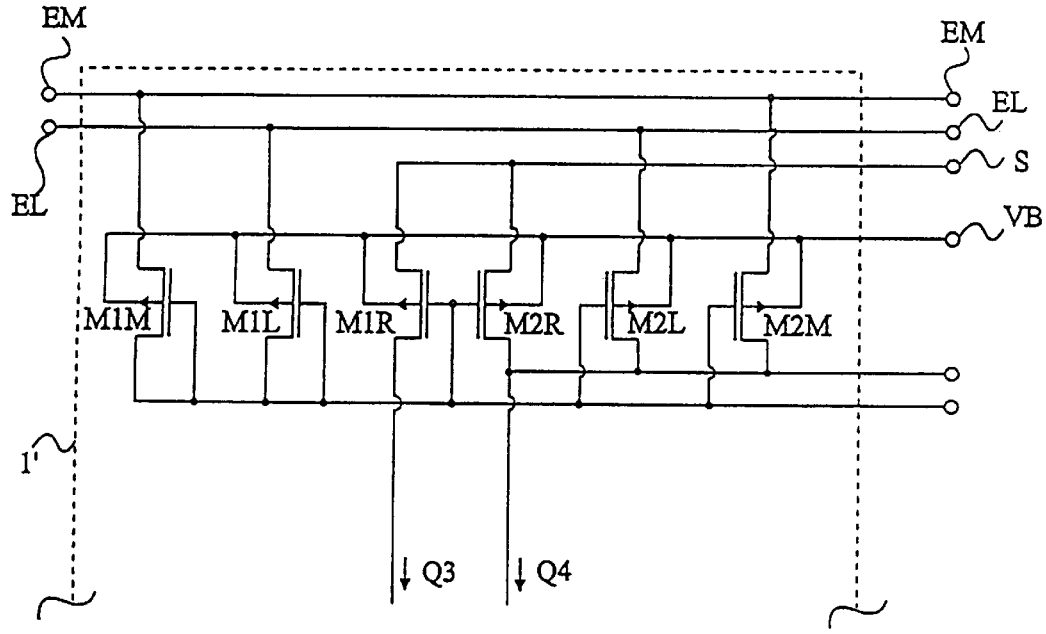
FIG. 9 partially shows a voltage reference circuit according to another embodiment of the present invention.
Figure 10:
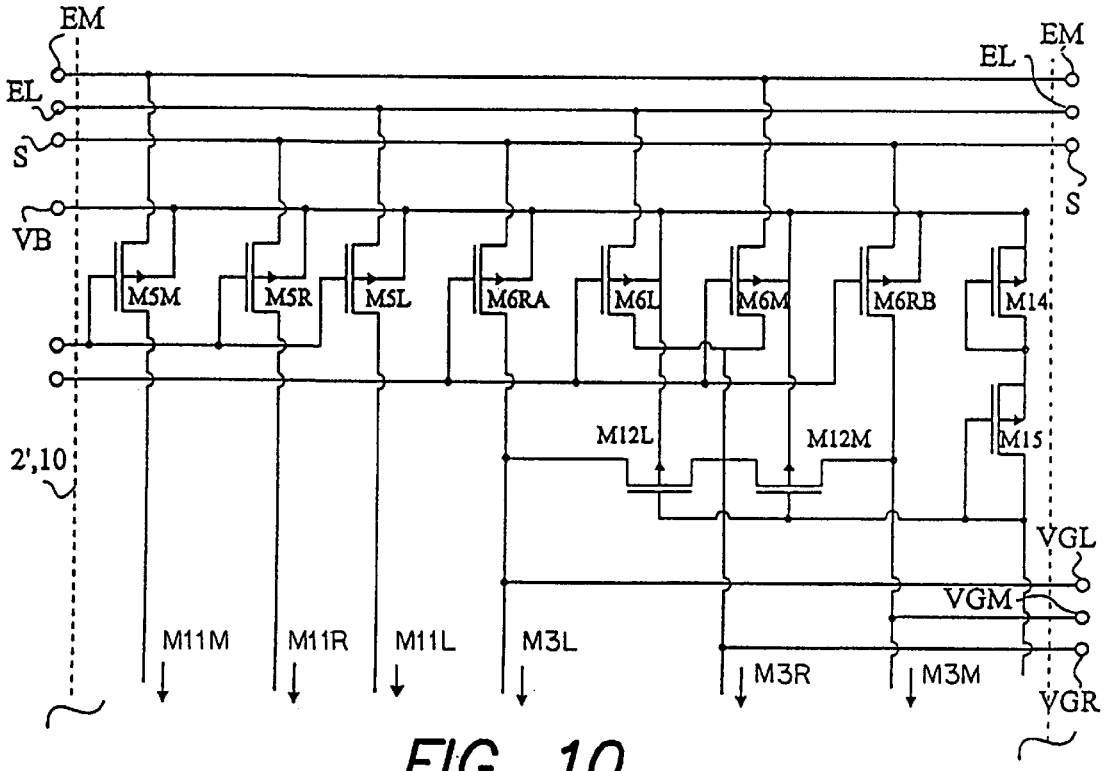
FIG. 10 partially shows a circuit for controlling power transistors of a regulator according to another embodiment of the present invention.

FIGS. 9 and 10 illustrate another embodiment according to which the upper transistors of circuit 1', 2', and 10 are P-channel MOS transistors. In FIGS. 9 and 10, only the upper parts of circuits 1', 2', and 10 have been shown.

Transistors Q1R, Q1L, and Q1M are replaced, respectively, with P-channel MOS transistors M1M, M1L, and M1R (FIG. 9). Transistors Q2M, Q2L, and Q2R are replaced, respectively, with transistors M2M, M2L, and M2R. The bulks of these P-channel MOS transistors are all connected to terminal $V_B$ to guarantee the insulation between voltages $V_M$, $V_L$, and $V_R$.

The bipolar transistors of circuit 2' are replaced with P-channel MOS transistors, having similar references in FIG. 10, replacing letter Q with letter M. All the bulks of these P-channel MOS transistors are then connected to terminal $V_B$.

Of course, the present invention is likely to have various alterations, modifications, and improvements which will readily occur to those skilled in the art. In particular, the sizings of the transistors and resistors is within the abilities of those skilled in the art according to the desired functional characteristics.

Further, although reference has been made in the foregoing description to a voltage regulator supplied with two independent unregulated voltages, the present invention also applies to the case where the regulator has to be supplied with more than two voltages. In this case, one only needs add, to each of the structures described in relation with the foregoing drawings, a transistor or a group of transistors associated with the additional input terminal.

Further, it should be noted that the regulator according to the present invention can be integrally implemented in bipolar technology by replacing the P-channel MOS transistors with PNP transistors and the N-channel MOS transistors with NPN transistors. In this case, it is not necessary to provide a circuit 13 for biasing the bulks of the P-channel MOS transistors. The use of MOS transistors however constitutes a preferred embodiment according to the present invention since they are voltage-controllable, which results in less consumption of the regulator.

Finally, it should be noted that the present invention also applies to the implementation of a negative voltage regulator. For this purpose, it is enough to replace the P-channel MOS transistors with N-channel transistors, and conversely, and to replace the PNP-type bipolar transistors with NPN-type bipolar transistors, and conversely. The voltage selection is then performed on the voltage having the most negative value.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. An apparatus, including:

a linear voltage regulator having:

at least one input terminal for receiving a supply voltage;

a circuit for generating a reference voltage proportional to a desired regulated output voltage;

an amplifier of a signal that represents an error between the reference voltage and the output voltage assigned with a coefficient of proportionality; and a capacitor connected between an output terminal and the ground, and means for supplying at least the circuit and the amplifier with the output voltage in case of a deficiency or a disappearing of the supply voltage present on the input terminal.

2. An apparatus according to claim 1, the linear voltage regulator further including a comparator for issuing, when the regulator is supplied by the output voltage, a logic signal indicating that the output voltage becomes lower than a threshold value proportional to the reference voltage.

3. An apparatus according to claim 1, the linear voltage regulator further including:

a conducting means for connecting the output voltage to the reference voltage in case of a deficiency or a disappearing of the supply voltage present on the input terminal.

4. An apparatus according to claim 3, wherein the connection between the output voltage and the reference voltage is resistive.

5. An apparatus according to claim 3, the linear voltage regulator further including at least a first power transistor having a first power electrode directly connected to the input terminal and a second electrode connected to the output terminal, the conducting means being formed of a second transistor of low power in series with a first resistor mounted in parallel on at least a second resistor helping to set the proportionality coefficient.

6. An apparatus according to claim 5, the linear voltage regulator further including a circuit for turning on the transistor associated with the highest voltage among the supply voltage and the output voltage.

7. An apparatus according to claim 5, wherein at least the first power transistor is a P-channel MOS transistor, the bulk of which is biased by means of the highest voltage between the input voltage and the output voltage.

8. An apparatus according to claim 6, the linear voltage regulator further including a selector circuit for turning on the first power transistor if the supply voltage is higher than the output voltage and turning on the second transistor if the output voltage is higher than the supply voltage.

9. An apparatus comprising:

a linear voltage regulator having:

at least one input terminal for receiving a supply voltage;

a first circuit means for generating a reference voltage proportional to a desired output voltage;

a second circuit means coupled from said first circuit means for providing a signal that represents an error between the reference voltage and the output voltage; and means for supplying at least the first and second circuit means with the output voltage when the supply voltage at the input terminal falls below a given level.

10. An apparatus according to claim 9, the linear voltage regulator further including a capacitor connected between an output terminal and a voltage potential.

11. An apparatus according to claim 10 wherein said voltage potential is ground.

12. An apparatus according to claim 9 wherein said second circuit means includes an amplifier.

13. An apparatus according to claim 12, the linear voltage regulator further including a comparator means for issuing, when the regulator is supplied by the output voltage, a logic signal indicating that the output voltage becomes lower than a threshold value proportional to the reference voltage.

14. An apparatus according to claim 13, the linear voltage regulator further including a resistor network coupling between the output voltage terminal and the comparator.

15. An apparatus according to claim 12, the linear voltage regulator further including a conducting means for connecting the output voltage to the reference voltage in case of a deficiency or a disappearing of the supply voltage present on the input terminal.

16. An apparatus according to claim 15, wherein the connection between the output voltage and the reference voltage is resistive.

17. An apparatus according to claim 15 wherein the error between the reference voltage and the output voltage is assigned with a coefficient of proportionality.

18. An apparatus according to claim 17, the linear voltage regulator further including at least a first power transistor having a first power electrode connected to the input terminal and a second electrode connected to the output terminal.

19. An apparatus according to claim 18 wherein the conducting means includes a second transistor of low power in series with a first resistor mounted in parallel on at least a second resistor helping to set the proportionality coefficient.

20. An apparatus according to claim 19, the linear voltage regulator further including a circuit for turning on the transistor associated with the highest voltage among the supply voltage and the output voltage.

21. An apparatus according to claim 19, wherein at least the first power transistor is a P-channel MOS transistor, the bulk of which is biased by means of the highest voltage between the input voltage and the output voltage.

22. An apparatus according to claim 19, the linear voltage regulator further including a selector circuit for turning on the first power transistor if the supply voltage is higher than the output voltage and turning on the second transistor if the output voltage is higher than the supply voltage.

23. An apparatus comprising:

a linear voltage regulator having:

at least one input terminal for receiving a supply voltage;

a first circuit for generating a reference voltage proportional to a desired output voltage;

a second circuit coupled from said first circuit and including amplifier means for providing a signal that represents an error between the reference voltage and the output voltage assigned with a coefficient of proportionality; and a monitoring circuit intercoupling with the first and second circuits and supplying the first and second circuits with the output voltage when the supply voltage at the input terminal falls below a given level.

24. An apparatus according to claim 23, the linear voltage regulator further including a capacitor connected between an output terminal and a voltage potential.

25. An apparatus according to claim 24 wherein said voltage potential is ground.

26. An apparatus according to claim 23, the linear voltage regulator further including a comparator for issuing, when the regulator is supplied by the output voltage, a logic signal indicating that the output voltage becomes lower than a threshold value proportional to the reference voltage.

27. An apparatus according to claim 23, the linear voltage regulator including:

a conducting means for connecting the output voltage to the reference voltage in case of a deficiency or a disappearing of the supply voltage present on the input terminal.

28. An apparatus according to claim 27, wherein the connection between the output voltage and the reference voltage is resistive.

29. An apparatus according to claim 28, the linear voltage regulator including at least a first power transistor having a first power electrode connected to the input terminal and a second electrode connected to the output terminal.

30. An apparatus according to claim 29 wherein the conducting means includes a second transistor of low power in series with a first resistor mounted in parallel on at least a second resistor helping to set the proportionality coefficient.

31. An apparatus according to claim 30, the linear voltage regulator including a circuit for turning on the transistor associated with the highest voltage among the supply voltage and the output voltage.

32. An apparatus according to claim 30, wherein at least the first power transistor is a P-channel MOS transistor, the bulk of which is biased by means of the highest voltage between the input voltage and the output voltage.

33. An apparatus according to claim 30; the linear voltage regulator further including a selector circuit for turning on the first power transistor if the supply voltage is higher than the output voltage and turning on the second transistor if the output voltage is higher than the supply voltage.

34. An apparatus comprising:

a linear voltage regulator having:

at least one input terminal for receiving a supply voltage;

a first circuit for generating a reference voltage proportional to a desired output voltage;

a second circuit for providing a signal that represents an error between the reference voltage and the output voltage;

a capacitor connected at an output terminal;

a first power transistor having a first electrode connected to the input terminal and a second electrode connected to the output terminal; and a second transistor having a first electrode connected to the output terminal.

35. An apparatus according to claim 34, the linear voltage regulator further including a resistive network coupling to a second electrode of the second transistor.

36. An apparatus according to claim 35 wherein said resistive network includes at least first and second resistors to set a proportionality coefficient.

37. An apparatus according to claim 36, the linear voltage regulator further including a selector circuit for turning on the transistor associated with the highest voltage among the supply voltage and the output voltage.

38. An apparatus according to claim 36, the linear voltage regulator further including a selector circuit for turning on the first power transistor if the supply voltage is higher than the output voltage and turning on the second transistor if the output voltage is higher than the supply voltage.

39. An apparatus according to claim 34, the linear voltage regulator further comprising a third circuit, coupled to a second electrode of the second transistor, for generating a signal indicating that the output voltage is higher than the supply voltage and lower than a threshold voltage.

* * * * *